US006350116B1

(12) United States Patent
Herrmann

(10) Patent No.: US 6,350,116 B1
(45) Date of Patent: Feb. 26, 2002

(54) PRE-VAPORIZING AND PRE-MIXING BURNER FOR LIQUID FUELS

(76) Inventor: Stephan Herrmann, Liststrasse 8, D-71336 Waiblingen (DE)

( * ) Notice: Subject to any disclaimer, the term of this patent is extended or adjusted under 35 U.S.C. 154(b) by 0 days.

(21) Appl. No.: 09/147,807

(22) PCT Filed: Aug. 12, 1997

(86) PCT No.: PCT/EP97/04374

§ 371 Date: Mar. 12, 1999

§ 102(e) Date: Mar. 12, 1999

(87) PCT Pub. No.: WO98/11386

PCT Pub. Date: Mar. 19, 1998

(30) Foreign Application Priority Data

Sep. 12, 1996 (DE) ..... 196 37 025

(51) Int. Cl.[7] ..... F23D 11/24; F23D 11/36; F23D 11/44

(52) U.S. Cl. ..... 431/208; 431/207; 431/240; 431/247; 431/11; 431/6

(58) Field of Search ..... 431/6, 2, 11, 207, 431/208, 240, 247; 123/557, 531

(56) References Cited

U.S. PATENT DOCUMENTS

| | | | | |
|---|---|---|---|---|
| 4,013,396 A | | 3/1977 | Tenney | |
| 4,301,966 A | * | 11/1981 | Schwarz | 239/75 |
| 4,392,820 A | * | 7/1983 | Niederholtmeyer | 431/11 |
| 4,533,316 A | | 8/1985 | Takino et al. | |
| 5,149,260 A | * | 9/1992 | Foust | 431/111 |
| 5,888,060 A | * | 3/1999 | Velke | 431/11 |

FOREIGN PATENT DOCUMENTS

| | | | | |
|---|---|---|---|---|
| AT | 230519 | * | 12/1963 | |
| CH | 342334 | | 10/1957 | |
| CH | 636941 | * | 6/1983 | 431/11 |
| DE | 1401756 | | 2/1969 | |
| DE | 2239317 | | 4/1973 | |
| DE | 2456526 | | 6/1975 | |
| DE | 3230674 | * | 7/1983 | 431/11 |
| DE | 3226023 A1 | | 1/1984 | |
| DE | 3316229 | * | 11/1984 | 431/11 |
| DE | 3403471 A1 | | 8/1985 | |
| DE | 03900805 | * | 7/1990 | 431/11 |
| DE | 29602969 U1 | | 8/1996 | |
| DE | 19518787 A1 | | 11/1996 | |
| FR | 236044 | * | 2/1978 | 431/11 |

* cited by examiner

*Primary Examiner*—Carl D. Price
(74) *Attorney, Agent, or Firm*—Jones, Tullar & Cooper, P.C.

(57) ABSTRACT

The invention concerns a pre-vaporizing and pre-mixing burner for liquid fuels which has a fuel feed line (56), a pump which pressurizes the fuel in the feed line, a mixing region (123) and a fuel valve (119) which opens out into the mixing region and by means of which the fuel is atomized and fed to the air for combustion (127). According to the invention, the fuel is vaporized in an optimum manner in that the fuel valve opens automatically as from a given fuel pressure, and a heating device (128) is associated with the fuel valve.

22 Claims, 6 Drawing Sheets

PRE-VAPORIZING AND PRE-MIXING BURNER FOR LIQUID FUELS

FIELD OF THE INVENTION

The present invention relates to a method for providing a combustible mixture of a liquid fuel and combustion air, as well as a prevaporizing and premixing burner for liquid fuels, having one or several fuel heaters for heating the liquid fuel prior to combustion.

BACKGROUND OF THE INVENTION

In the field of household and small consumers (HuK) it is known to burn fuel oil EL for heating purposes or for purposes of thermal process technology in a pressure atomizer burner. The liquid fuel oil EL is converted under high pressure (500 to 2000 kPA) into a fog of droplets by means of an atomizer nozzle and is simultaneously mixed with the supplied combustion air. A method exists in addition, wherein fuel oil EL is atomized by means of compressed air. Further than that there are vaporization burner devices, wherein the liquid fuel is vaporized on the surface of a heated body which is surrounded by combustion air.

The following problems are connected with the present-day burners: in conventional oil burners, the liquid fuel oil EL is converted into a fog of droplets by means of an atomizer nozzle and simultaneously mixed with the supplied combustion air. The processes, such as atomizing, mixing, vaporizing and gasification of the fuel, as well as the combustion of the gasified fuel, occur unregulated side-by-side and in an interacting manner. The individual oil droplets are surrounded by a flame envelope. The high temperatures in the vicinity of the drops, together with the simultaneously occurring lack of air, trigger cracking processes, by which soot is formed.

Present-day blue flame burners avoid the generation of soot in that they vaporize the fuel at the flame root prior to combustion. Here hot flue gases returned from the flame zone here vaporize the oil spray emerging from a swirl nozzle. The water content of the returned flue gases prevents the formation of long-chain hydrocarbons, which can only be burned along with the generation of soot. The method of recirculating the exhaust gases lowers the nitrous oxide emissions in addition to the soot emissions. In order to convey a sufficiently large amount of hot flue gas into the flame root, a correspondingly large induction effect of the fuel/air jet within the mixture preparation is required. The induced mass flow is affected for one by the velocity of the emerging mixture flow and also by the cross section of the open jet. Both parameters can only be varied within certain limits. A high outlet velocity leads to loud flow noises, an increased blower output and large burner dimensions. An increase in the outlet cross section, together with a reduction in velocity, leads to ignition conditions already being created in the vaporization area, so that the intended fuel vaporization, which is uncoupled from the combustion reaction, does not occur. Moreover, the pulse exchange between the fuel and the combustion air is reduced, by which the mixture is also negatively affected. In addition, a high outlet velocity at the twist generator prevents a flame formation in the near range of the mixing device and thereby leads to a reduced thermal stress of these components. It follows from this that in connection with present-day mixture preparation methods for oil burners a reduction of the noxious matter emissions is always connected with an increase in the velocity of the combustion air, and therefore leads to increases in noise emissions and the required blower output.

In a burner system having a firing equipment output of 15 kW, a reduction of the fuel oil flow rate is not possible with conventional oil pressure atomizer nozzles. For reducing the throughput, the nozzle cross section cannot be further reduced for reasons of dependability. The pump pressure can also not be arbitrarily reduced, because the atomizing quality is clearly reduced.

Conventional oil burners are heterogeneous systems, i.e. the dispersed phase fuel oil EL and the dispersion medium air exist as discrete phases side-by-side and are separated by a phase boundary. The roughly dispersed fuel distribution caused by atomizing does not make it possible to mix the fuel without prior vaporization in front of the flame, because the individual fuel droplets settle under the effects of gravity and are deposited on the mixing chamber walls. For this reason a premixing surface burner device, such as can be used in the field of gas combustion, is not possible.

Modem gas burner devices show that a reduction of the nitrous oxide emissions is most effectively achieved by means of a premixing burner system.

A gasification device for fuel oil and kerosene is known from German patent DE-C2-24 56 526, and an oil heating device from German published application DE-OS 14 01 756, wherein the fuel is heated prior to atomizing. Although heating the fuel leads to improved and finer atomizing, problems occur because of cracking product depositions, such as clogging of the lines, etc.

SUMMARY OF THE INVENTION

The above mentioned problems are solved by the present invention by the provision of a method wherein: the liquid fuel is put under pressure in a heating phase with the fuel valve closed; the fuel under pressure and in liquid form is heated; following the heating phase the fuel valve is opened and the heated liquid fuel under pressure is atomized and vaporized through a nozzle; the vaporized fuel is mixed with combustion air, where at least a part of the vaporized fuel is condensed, so that a colloid-dispersed and/or a molecular-dispersed fuel-air mixture is created; the fuel valve is closed to terminate combustion; and, with the fuel valve closed, the heated and liquid fuel is cooled;

The advantages which can be achieved by means of the present invention consist in particular in that, with the method on which the present invention is based, a colloid-dispersed or molecular-dispersed fuel distribution occurs, depending on the degree of air preheating. A mixed form of both distribution types is also conceivable. Because of the stability of the colloid-dispersed fuel distribution, it is possible to mix the reactants ahead of the flame without the fuel droplets being deposited on the mixing chamber walls. Here, the mixing of the reactants is possible completely spatially decoupled from the combustion reaction, and not, as with conventional emission-reducing oil burners (so-called blue flame burners), only inside a very small gasification zone ahead of the flame, which is in direct convective heat exchange with the flame via the flue gas recirculation. Because the mixture of fuel and combustion air is now no longer limited to the gasification zone ahead of the flame, the premix burner devices known from gas burner technology, which make possible a very intensive mixing of the reactants, can now also be employed for liquid fuels. The known advantages of this burner technology are therefore also now usable for liquid fuels. Among these are:

(a) low emissions (soot, nitrous oxide, carbon monoxide) when using a surface combustion system;

(b) low noise emissions;

(c) small blower output required;

(d) a combustion air blower system can possibly completely omitted (atmospheric mixture formation);

compact heat generator construction because of the direct coupling of the heat exchanger on the heating cycle side to the reaction zone, which can be spatially exactly determined.

The core of the prevaporizing, premixing combustion technique is constituted by the heating of the liquid fuel oil under pressure. Vaporization of the fuel oil only takes place at the nozzle outlet in contrast to conventional vaporization burner devices, wherein the oil impinges with almost no pressure on a hot surface, which results in the deposition of low-volatile fuel oil components. Maintaining the above mentioned pressure conditions in the operational phases, in which heated fuel oil is in the hydraulic system of the burner, prevents these deposits. Both during the heating phase and during the cooling phase, the oil lines from the pump to the heated fuel valve are pressure sealed, or the pressure in the system is maintained by means of an oil pump or of a compensation vessel (for example metal bellows).

A fuel valve with "atomizing characteristics" is used in the system in accordance with the present invention, which unblocks the nozzle opening starting at a defined pressure. The oil vaporization triggered by the pressure reduction at the valve outlet causes an extreme increase in volume, and therefore a considerable reduction of throughput in comparison with the operation of the fuel valve with fuel oil which was not preheated. When using a swirl nozzle, a reduction of the throughput is caused by the reduction in viscosity connected with preheating the fuel. The air core within the nozzle opening increases with increasing fuel temperature and the fuel throughput decreases. The extreme preheating makes it possible to design the nozzle opening considerably larger, in particular with small throughputs, than would be possible with conventional pressure atomizer systems. Because of employing the twist principle in a return flow nozzle with an integrated needle valve, the required output of the firing equipment can be further reduced.

In a further development of the present invention it is provided that the heating device is constituted by at least one electric heating rod, heating element or heating cartridge. The heating device is designed in such a way that at maximum throughput the fuel is heated to the desired temperature. It is advantageous to provide the fuel valve additionally with a temperature sensor, for example a thermal element or the like, so that its temperature can be detected for regulating the heating output of the heating device.

A particularly simple exemplary embodiment provides that the heating device is placed into the fuel valve. In this case the individual heating cartridges or the like can be inserted into bores, for example. However, it is also conceivable that the heating device can be installed on the fuel valve, for example flanged to it, so that there is a direct contact between the heating device and the fuel valve.

With one exemplary embodiment, the fuel valve is embodied as a simplex nozzle with a closing piston. In this case the closing piston can be located outside or inside of the fuel valve.

A further development provides that the fuel valve has a return flow opening and can be combined with a return flow line. A return flow system is created in this way and the fuel valve is used as the return flow nozzle.

When the hydraulic system is laid out as a return flow system, direct electric heating of the valve, or respectively of the valve body, is not necessary. It is sufficient to heat the fuel by means of an electrically heated fuel heater which is remote from the fuel valve and is arranged upstream of the fuel valve, viewed in the flow direction. Transferring the fuel by pumping at a small pressure difference between the forward flow and return flow pressure prior to opening the valve causes heating of the fuel volume inside the valve. In this way the emergence of insufficiently heated fuel immediately following the opening of the fuel valve is prevented.

The return flow nozzle can a for example a have an integrated needle valve, which pressure-seals the nozzle opening during the heating and cooling phase. The movement of the valve tappet is made possible by means of the pressure difference between the forward and return flow pressure. Transferring the fuel oil by pumping at a small pressure difference between the forward flow and return flow pressure prior to opening the valve prevents the emergence of insufficiently heated fuel oil. For cooling the hot returned oil mass flow it is possible to additionally provide an oil cooler, which heats the combustion air, upstream of the pump inlet. Depending on the degree of air preheating, the proportion of the gaseous fuel in the fuel/air mixture increases. The pulse exchange between the combustion air and the fuel, which affects the quality of the mixture, also increases with increasing air temperature.

A further development provides that an adjustable flow resistor for pressure regulation, as well as an adjustable check valve, are provided in the return flow line.

With a return flow line which is merely used as a leakage line, no special measures for cooling the very small oil mass flow are necessary. For example, with a coaxial combination of the oil feed line and the oil return line, the cooling action of the fed-in oil mass flow is sufficient. Finally, embodiments are known, with which a return flow line is not required.

A burner with a fuel valve terminating into free space immediately after the valve tappet has the advantage that, depending on the degree of air preheating, a colloid-dispersed or molecular-dispersed dispersed fuel distribution occurs. Because of the stability of the colloid-disperse or respectively the molecular-dispersed distributed fuel it is possible to mix the reactants already ahead of the flame in an area of large volume without the fuel droplets being deposited on the mixing chamber walls. Therefore, mixing of the reactants is possible completely spatially decoupled from the combustion reaction, and not, as with conventional emission-reducing oil burners (so-called blue flame burners), only inside a very small gasification zone ahead of the flame, which is in direct convective heat exchange with the flame via the flue gas recirculation. The low temperature of the quasi-homogeneous mixture of the burner in accordance with the present invention permits intensive mixing in a mixing zone of large volume without the danger of spontaneous ignition. Now the mixing of fuel and combustion air is no longer limited to the gasification zone ahead of the flame. By employing a return flow nozzle in connection with extreme preheating of the fuel under pressure in particular, a small required firing equipment output can be achieved with operational dependability. Moreover, a large advantage is achieved in that deposits of cracking products are prevented, since the fuel vaporization takes place in the free atmosphere and not, as in film vaporization burners, at a hot surface in the presence of oxygen.

The heating zone is located in the direct vicinity of the reaction body, but is spaced apart from it. With another exemplary embodiment, the heating zone is connected directly with the reaction body. By means of this embodiment the fuel is heated during its passage past the heating zone by the reaction body which, as a rule, is red hot during operation. Therefore separate heating devices are not required during operation. In this case heating can be accomplished by means of radiated energy, by means of convection or by direct contact by means of heat conduction.

With a particularly preferred exemplary embodiment the heating zone is designed as a ring conduit. In this way a comparatively large surface for the inflowing fuel is created, so that it can be rapidly heated, for example by radiation. With a sleeve-like reaction body enclosing the ring conduit in particular, a very large surface for heating is available.

With another embodiment it is provided that the heating zone is designed as a spiral tube. The fuel to be heated is conducted through this spiral tube, wherein the reaction body directly radiates against the spiral tube.

In the preheating phase prior to the start of the burner, the fuel is heated in that an electric heating cartridge is provided, which is connected with the heating zone. In particular, the heating zone rests directly against the heating cartridge, so that the heat from the heating cartridge is transferred by heat conduction to the heating zone and from there to the fuel. In this case the heating cartridge can be designed as a heating rod or a heating spiral.

In a preferred embodiment, sections of the heating cartridge are in connection with the area through which the fuel-air mixture is conducted, wherein a flashback arrester is provided in the direction toward the mixture preparation. In this exemplary embodiment the heating cartridge is additionally used as an ignition device, wherein the fuel-air mixture is ignited on the casing of the heating element, which as a rule is red hot. Separate ignition devices are therefore superfluous.

Further advantages, characteristics and details ensue from the claims as well as from the following description, in which several preferred exemplary embodiments and variations are described in detail, making reference to the drawings.

DESCRIPTION OF THE PREFERRED EMBODIMENTS

Figure 1:
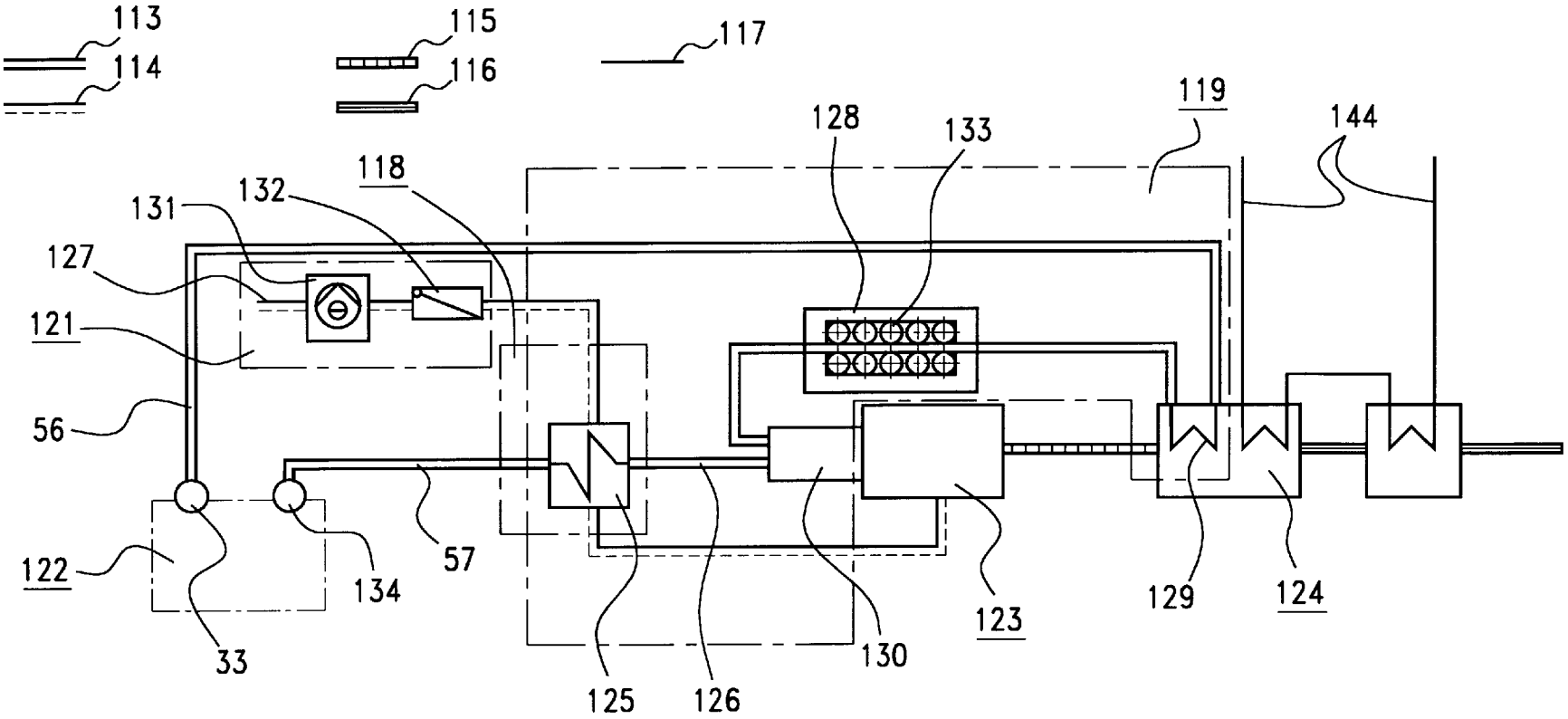
FIG. 1: is a schematic representation of a prevaporizing, premixing burner for liquid fuel according to the present invention.

The fuel lines 113, the air-conducting components 114, the components 115 conducting the fuel/air mixture, the components 116 conducting the flue gas and the water lines 117 of the heating circuit 144 are schematically represented in FIG. 1.

The burner in accordance with FIG. 1 comprises the functional units 118 for air preparation, fuel preparation, 121 for air regulation, 122 for fuel regulation, mixing zone 123 and reaction zone 124.

The air preparation unit 118 consists of a heat exchanger 125 for preheating air, which removes heat from the return flow of fuel 126 and transmits it to the supplied combustion air 127.

The fuel preparation unit 119 consists of an electrically heated fuel heater 128, the heat exchanger 125 in the return flow line 126, which is connected with the air preparation unit 118, and a heat exchanger 129, which transfers a portion of the heat being released during the combustion reaction to the fuel preparation unit 119, and a return flow nozzle 130 with an integrated needle valve.

The air regulation unit 121 consists of a blower 131 and an air throttle 132, which can be actuated electro-mechanically or mechanically, by means of which an automatic adaptation of the conveyed air mass flow to the actual air requirements of the firing equipment is possible.

Figure 2:
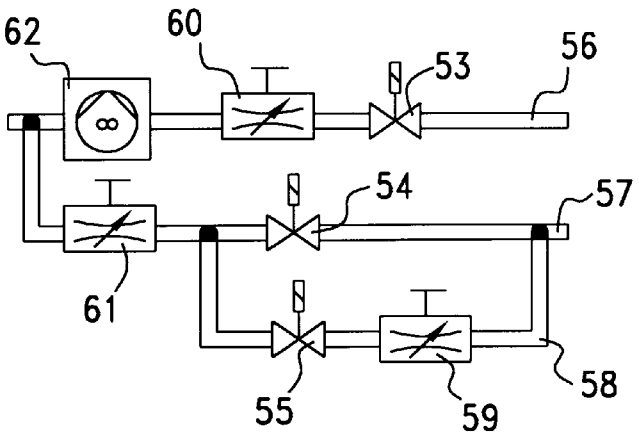
FIG. 2: a shows an arrangement for the regulation of fuel feeding.

When the burner is started, the burner control switches the burner motor on, which is coupled with the oil pump 62 (FIG. 2) and the blower 131. The check valves 53, 54 and 55 are initially closed. Thereafter, the electro-mechanically actuable check valve 53 in the forward flow line 56 and the electro-mechanically actuable check valve 55 in the side branch 58 of the return flow line 57 are opened. Simultaneously the burner control switches on the electrically operated heating element 133 in the fuel heater 128. In this operational phase, the oil pump 62 conveys the fuel through the fuel preparation unit 119 and the heat exchanger 125 coupled to the air preparation unit 118. Because of the low pressure difference between the measuring points 33 for the forward flow pressure and 134 for the return flow pressure 134, the needle valve in the return flow nozzle 130 remains closed. This pressure difference can be variably set by the mechanically operated pressure regulating valves 60 and 59. Here, the minimum pressure in this system corresponds to the pressure value which can be detected at the measuring point 134 for the return flow pressure. Thus, an overpressure in comparison with atmospheric pressure prevails in all components through which the heated fuel flows. By means of this it is assured that no low-boiling fuel components are vaporized during the heating of the fuel and the remaining high-boiling fuel components do not form deposits in the hydraulic system. Moreover, the transfer of fuel by pumping prevents the premature emergence of insufficiently preheated fuel from the return flow nozzle 130.

By opening the electro-mechanically actuable check valve 54, the return flow pressure drops in the swirl chamber of the return flow valve 130 when the required oil temperature has been reached, and the needle valve unblocks the nozzle bore. Because of this, the fuel in the mixing zone 123 is atomized and forms a combustible mixture with the fed-in combustion air 127, which burns in the reaction zone 124. Either a conventional high voltage ignition system or an electrically heated ignition element is provided for igniting the mixture. Another possibility lies in using the high surface temperature of the electrically heated fuel heater 128 for igniting the mixture.

The return flow nozzle 130 is designed as a swirl nozzle, the same as in a conventional pressure atomizer burner. The throughput is reduced with increasing fuel temperatures. Moreover, the employment of a return flow nozzle 130 has the advantage that, at constant forward flow pressure, the ratio of fuel conveyed back and the amount of atomized fuel can be changed over a large range 1:10 by throttling the return flow pressure.

Preheating the fuel and the use of a return flow nozzle make it possible to select the nozzle cross section considerably larger at the same oil throughput than is possible with conventional pressure atomizer burners. A reduced clogging tendency of the nozzle opening and increased operational dependability of the system are the result.

With this method, the heated fuel, which is under pressure, is atomized in the dispersion agent air. A portion of the vaporized molecules is condensed into a colloid-dispersed system, the remaining portion is maintained as a stable gas and forms a homogeneous mixing system, the same as in a gas burner. The proportion of colloid-dispersed oil droplets and homogeneously mixed molecules is a function of the fuel composition, which is influenced by temperature- and pressure-dependent chemical reactions (for example cracking reactions in connection with the fuel oil EL as fuel), and the degree of air preheating.

The colloid-dispersed distributed fuel in this system is aggregated into droplets of such length that they are separated by a phase border from the dispersion agent, the air. On the other hand, however, the particles are so small that in their behavior they correspond to a large degree to dissolved molecules.

From this, the following advantages over a roughly dispersed fuel oil distribution of conventional pressure atomizer systems result: (a) the colloid-dispersed oil droplets are distributed in the combustion air through Brownian movements until their concentration has reached the same value at all locations of the system; (b) excellent constancy of the colloid-dispersed fuel; (c) the gaseous portion of the fuel forms a combustible mixture with the combustion air immediately following mixing by molecular transport. The laws of spray combustion apply to the colloid-dispersed portion of the fuel, the same as with conventional oil pressure atomizer burners. The accelerated heating and vaporization of the drops because of the small drop diameters, and the chronologically advanced combustion and the temperature increase connected therewith of the portion of the fuel already in the gas phase make it possible to speak of a "quasi-homogeneous combustion systems , in spite of the portion of the fuel which is in the liquid phase.

The electrical heating element 133 is switched off during the operating phase of the burner. The energy required for heating the fuel is taken out of the reaction zone 124. The heat exchanger 129 in the reaction zone and the fuel heater 128 are designed as a structural unit.

For turning off the burner, the burner control initially closes the check valve 54 in the return flow line 57 and the check valve 55 in the side branch 58 of the return flow line 57. Because of this the pressure difference between the forward and return flows at the measuring points 33 and 134 is reduced and the needle valve in the return flow nozzle 130 is closed. The combustion reaction is interrupted by this. The high pressure in the fuel preparation unit 119 prevents the vaporization of the still hot fuel after the burner has been shut off. At the end, the burner control closes the electromagnetic check valve 53 in the forward flow line 56 and turns off the burner motor.

Figure 3:
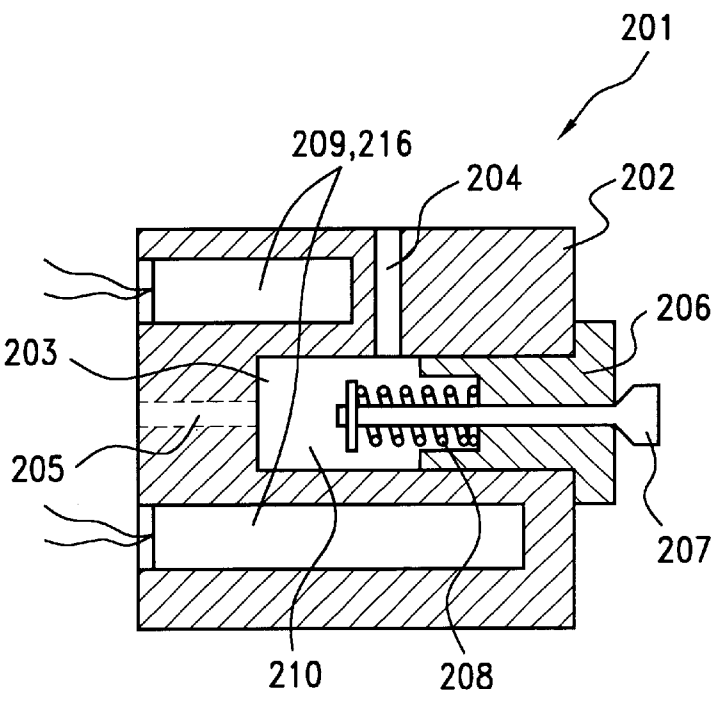
FIG. 3: is a first exemplary embodiment of a fuel valve with a closing piston according to the present invention.

A first exemplary embodiment of a burner valve, identified as a whole by 201, is represented in FIG. 3. This burner valve 201 has a housing 202 with a valve nozzle bore 203, in which a feed line (not represented) terminates through an opening 204. Optimally the fuel valve 201 can be provided with an additional opening 205, which also terminates in the valve nozzle bore 203. A return flow line (not represented) can be connected to this additional opening 205, so that the fuel valve 201 can be used in a purely forward flow system as well as in a return flow system. When used with a forward flow system, the opening 205 is closed by a plug.

A valve nozzle 206, into which a valve tappet 207 has been inserted, is screwed into the valve nozzle bore 203. This valve tappet 207 is maintained in the closed position by means of a closing spring 208. If the pressure in the valve nozzle bore 203 is increased past a defined value, the valve tappet 201 is pushed and the valve nozzle 206 automatically opens.

It can moreover be seen in FIG. 3 that heating cartridges 209 have been inserted into appropriate bores or other recesses of the housing 202. If the housing 202 is heated by means of these heating cartridges 209, which are electrically operated, the fuel present in the valve nozzle bore 203 is also heated. In this way the valve nozzle bore 203 is used as a preheating chamber 210. The fuel emerging from the valve nozzle 206 is preheated, from which the above mentioned advantages ensue.

Figure 4:
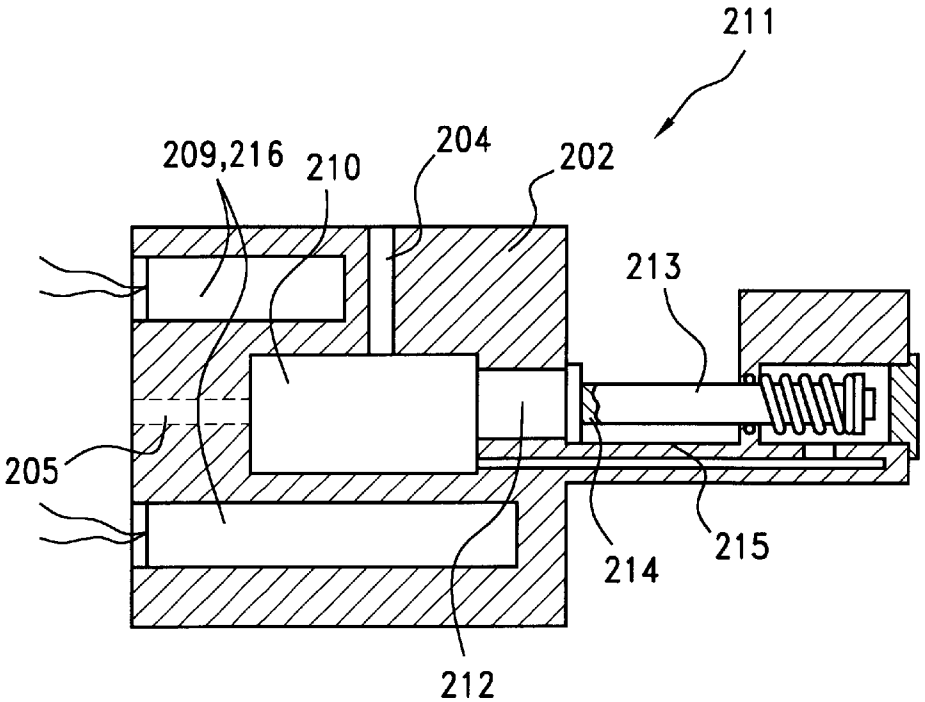
FIG. 4: a fuel valve with a closing piston designed in the way of a simplex nozzle.

FIG. 4 shows a second exemplary embodiment of a fuel valve, identified as a whole by 211, which has a slightly altered construction. The preheating chamber 210 terminates in a simplex nozzle 212, which is closed by a valve tappet 213. Here, too, the valve disk 214 is lifted off the opening of the simplex nozzle 212 when the fuel in the preheating chamber 210 has reached a defined pressure. Since the characteristics of a simplex nozzle are known, i.e. the reversely proportionate connection between throughput and temperature of the fuel, this will not be further discussed here. It should be noted that the seat 215 of the valve tappet 213 has been represented in FIG. 4 merely by way of example. Other constructions are conceivable and should also be covered by the present invention.

However, it is important that the fuel valves 201 and 211 are provided with a heating device 216 constituted by heating cartridges 209, wherein the heating cartridges 209 have been inserted into appropriate openings in the exemplary embodiments. It is, however, also conceivable that the heating device 216 is interlockingly mounted on the fuel valves 201 and 211. The housing 202 of the fuel valve 201, or respectively 211, is heated by means of the heating cartridges 209, and the fuel in the preheating chamber 210 is heated via this housing 202. When a defined temperature has been reached, or when the pressure of the fuel in the preheating chamber 210 has reached a defined value, the valve tappet 207, or respectively 213, is lifted and fuel can emerge from the fuel valve 201, or respectively 211. The fuel, which is under pressure and heated, is nebulized in the course of expansion and can be optimally mixed with the possibly preheated combustion air.

Figure 5:
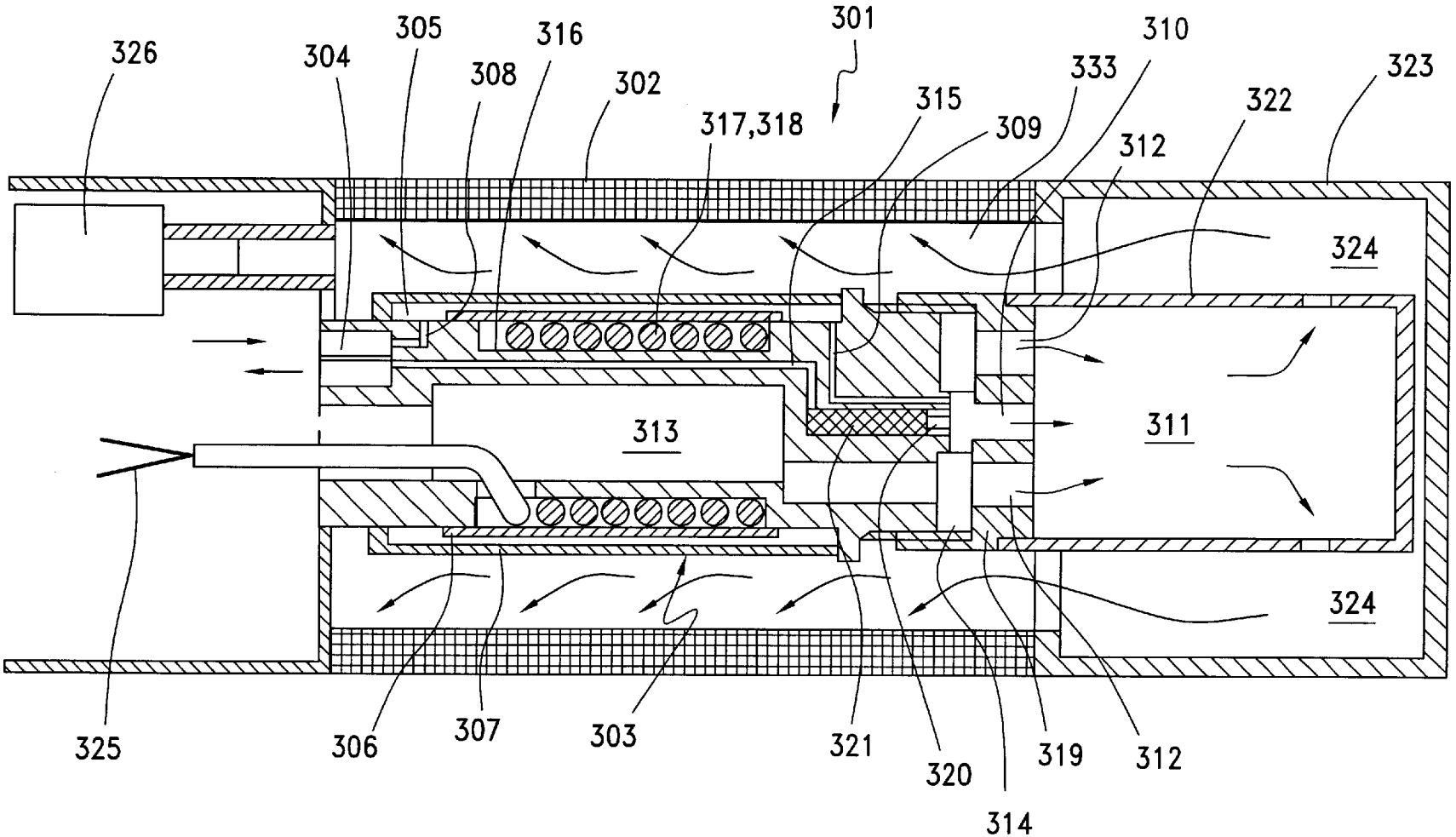
FIGS. 5 to 7: are longitudinal sectional views of embodiments of the burner in accordance with the present invention.

A burner, identified as a whole by 301, is represented in FIG. 5, which has the construction described in what follows. A heat exchanger element 303, in which the fuel is preheated, is located inside a dynamically balanced reaction body 302. It is fed through a supply line 304 to the heat exchanger element 303 and reaches a ring conduit 305 constituted by two concentric sleeves 306 and 307. The fuel is introduced into the ring conduit 305 through a connecting line 308, or respectively it is removed from the ring conduit 305 through a line 309. The line 309 terminates in a return flow nozzle 310, which is opened, starting at a defined pressure prevailing in the line 309 and atomizes the fuel into an inner mixing chamber 311. Air conduits 312 furthermore terminate in this mixing chamber, through which combustion air is supplied. This combustion air flows through the heat exchanger element 303 via a line 313 as well as a ring conduit 314.

With the return flow nozzle 310 closed or opened, the fuel supplied through the line 309 is returned into the tank through a return flow line 315. This return flow line 315 is located near the line 313, so that the fuel in the return flow line 315 is cooled by means of the air flowing through the line 313, or respectively the air is heated by this fuel. With large amounts of fuel conveyed back, a separate oil cooler is provided, through which either the supplied combustion air or the oil mass flow, or both, flow.

The heat exchanger element 303 has a circumferential groove 316, into which a heating element 317 in the form of a heating spiral 318 has been inserted. In the starting phase, this heating spiral 318 preheats the inner sleeve 306, and by the latter the fuel in the ring conduit 305. The fuel in the ring conduit 305 is under pressure here. The inner sleeve 306 is pressed on the heating spiral 318 and welded on its front faces, so that the heating spiral 318 is fixed in place and protected. The heating spiral 318 can be additionally provided with a thermal element (not shown).

The return flow nozzle 310 is located in a union nut 319, so that it can be rapidly removed when needed, for example for repair or maintenance purposes. The valve tappet 320, which is prestressed by a compression spring 321, can be seen at the rear of the nozzle 310. The fuel valve can also contain the spring as a structural unit.

The inner mixing chamber housing 322, around which the outer mixing chamber housing 323 is wrapped, has been placed on the union nut 319. Thus, there is a further mixing chamber 324 between the inner and outer mixing chamber housing, which is used for further homogenizing the fuel-air mixture. The mixture is supplied from this outer mixing chamber 324 to the reaction body 302 and flows through the latter radially toward the outside. After ignition, the mixture burns outside of the reaction body 302, so that the reaction body 302 is red hot during operation. The heat radiated by the reaction body 302 is radially transmitted toward the interior as well as toward the fuel-air mixture located between the reaction body 302 and the heat exchanger element 303 and to the outer sleeve 307, so that the mixture and the fuel in the ring conduit 305 are heated. The heating element 317, which is supplied with energy via the electric conductors 325, is switched off during operation, or respectively is operated in cycles, for example by means of a regulator, for maintaining a defined temperature.

Flame monitoring at the exterior of the reaction body 302 takes place by means of a flicker detector 326 facing the inside of the fire chamber or the premixing area and looking from below through the reaction body 302. Also possible is flame monitoring by means of an ionization electrode arranged above the reaction body or projecting inside it.

The embodiment of a burner represented in FIG. 5 has the considerable advantage that the fuel is heated within a very short time, in particular in the starting phase, because of the short distance of the oil film in the ring conduit 305 from the radiation source constituted by the reaction body 302. In this case the heat flows radially from the inside to the oil film. During burner operation the output of radiated heat from the reaction body heats up the outer sleeve of the ring conduit. The latter transfers the heat to the oil film. During the startup of the burner, the oil film is correspondingly heated radially from the inside, during burner operation heating is provided by the heat output (radiation, conduction) of the reaction body.

The ring conduit 305 moreover offers a large heat exchanging surface. The dynamically balanced reaction body 302 can alternatively also be embodied as a flat bottom wherein, in place of the ring conduit 305, a heat exchanger for heating the fuel must also be provided directly underneath this flat body.

Figure 6A:
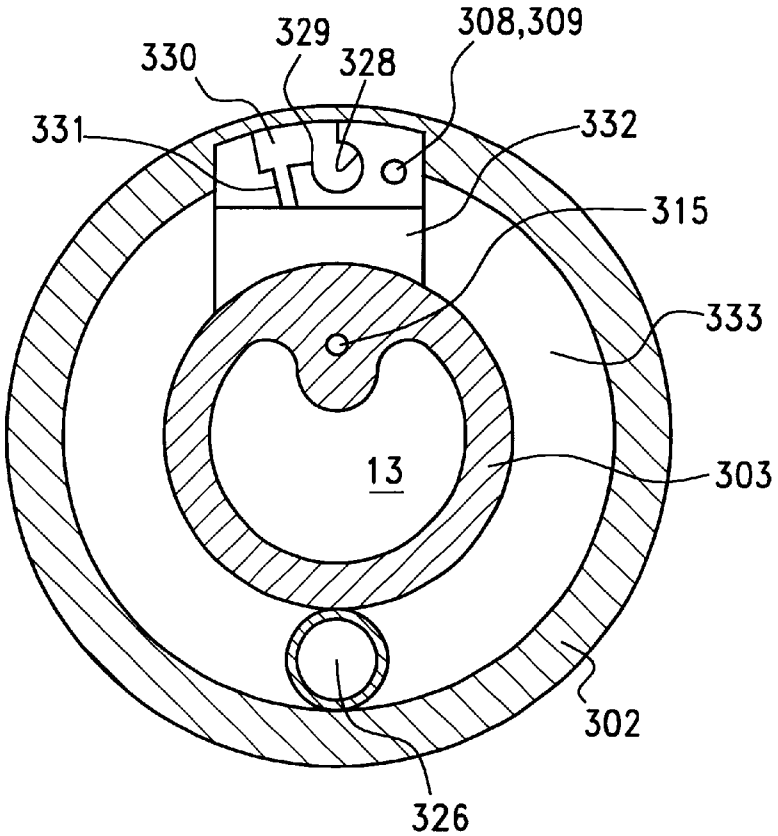
FIG. 6*a*: is a cross section of FIG. 6.
Figure 6:
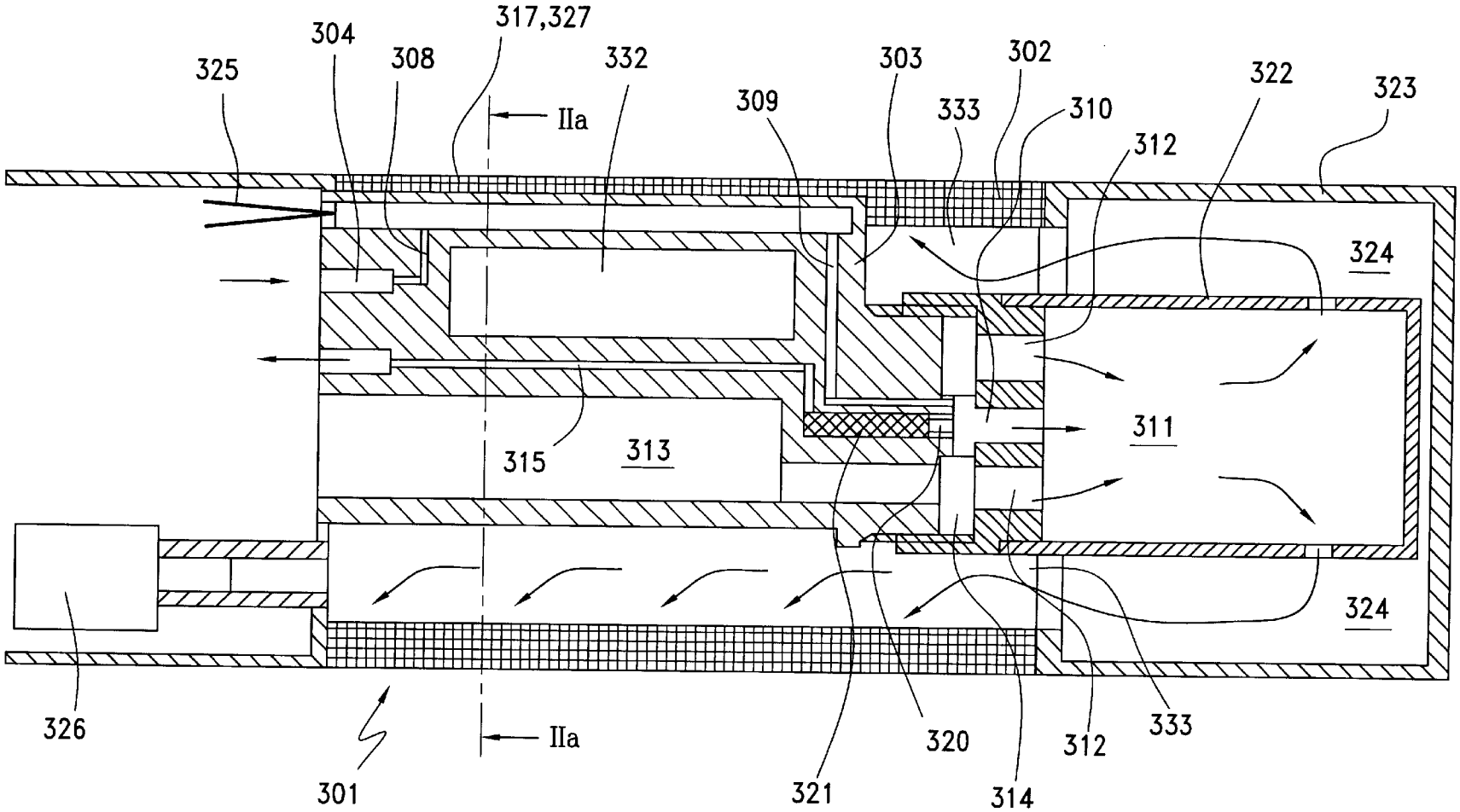

In the exemplary embodiment of FIG. 6, the heat exchanger element 303 directly contacts the reaction body 302, so that the fuel in the connecting line 308 is heated by heat conduction. The heating element 317 for heating the fuel in the starting phase is designed as a heating rod 327, which is inserted into a corresponding bore 328 (see FIG. 6*a*) of the heat exchanger element 303. This bore 328 is broken open segment-like over a part of its length, so that the heating rod 327 is openly accessible in this area 329. This area 329 is in connection via an opening 330 and a connecting line 331 with a chamber 332, which itself is connected via the ring conduit 333 with the outer mixing chamber 324. In this way the fuel-air mixture, which can enter the opening 330 via the connecting line 331, can be ignited by the red hot heating rod 327 at the end of the starting phase, so that the flame can penetrate through the reaction body 302, by means of which the burner 301 is started. A flashback of the flame through the opening 330 into the chamber 332 is achieved by means of the comparatively small cross section of the connecting line 331 and its length, so that a dependable flashback arresting device is created. The great velocity of the fuel-air mixture and the small distance between the surfaces and the relatively great length of the surfaces (extinguishing distance) of the connecting line 331 prevent the ignition of the mixture in the chamber 332.

Figure 7:
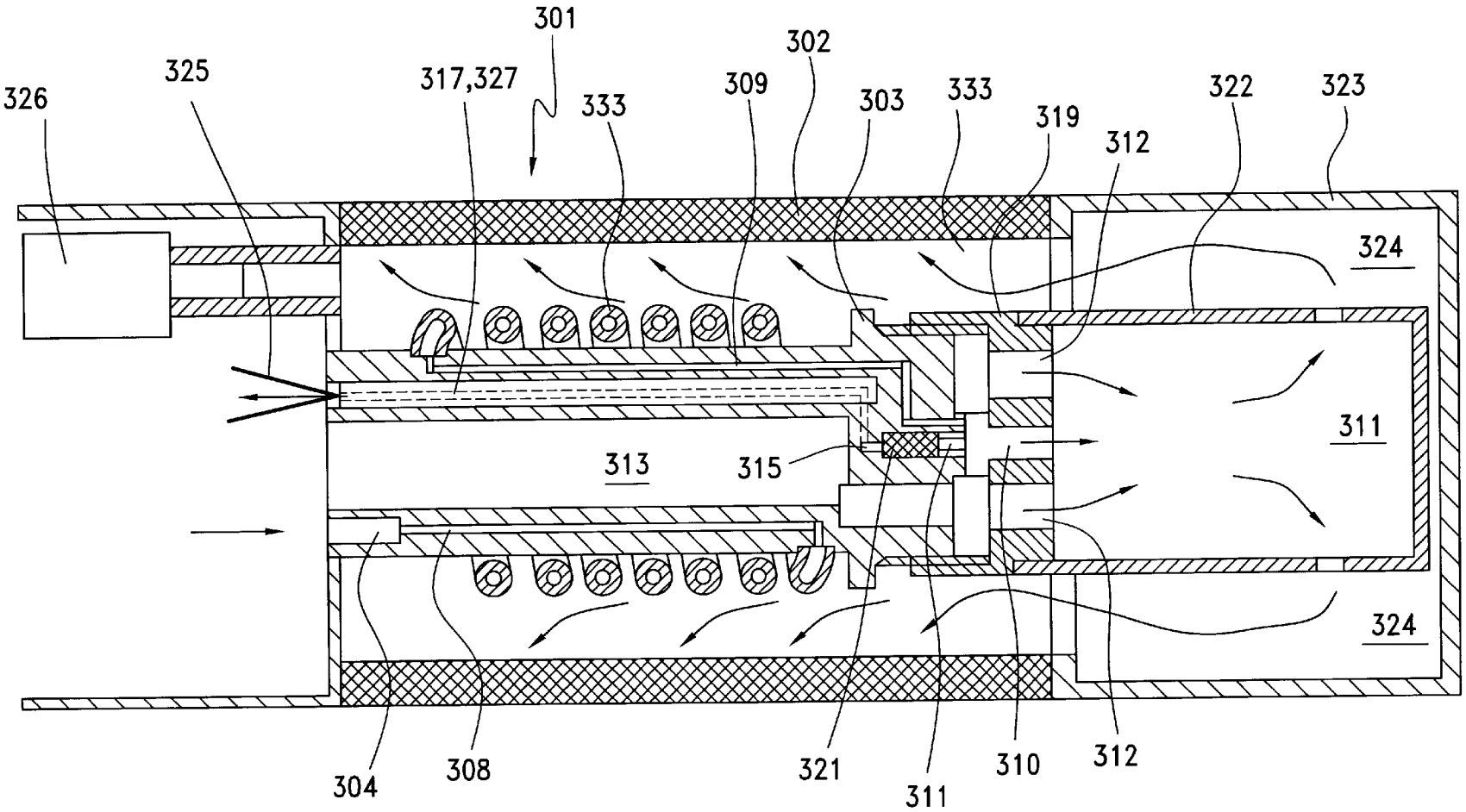

In the exemplary embodiment in FIG. 7, the heat exchanger element 303 is wrapped in a spiral tube 333, in which the fuel is conducted. This spiral tube 333 is connected both to the connecting line 308 and the line 309, wherein the flow through the spiral tube 333 is also a counterflow. This spiral tube 333 is irradiated by the reaction body 322, so that the fuel flowing in it is heated.

What is claimed is:

1. A prevaporizing and premixing burner for liquid fuels, comprising:

at least one fuel heater for heating the liquid fuel;

means for increasing the pressure of the liquid fuel;

a nozzle for atomizing and vaporizing the fuel and for mixing the fuel with combustion air, wherein at least a portion of the vaporized fuel condenses, creating thereby one of: a colloid-dispersed fuel-air mixture, a molecular-dispersed fuel-air mixture, and a colloid-dispersed and molecular-dispersed fuel-air mixture; and a hydraulic system with a blockable fuel valve which, during heating and prior to combustion, and during cooling following combustion, maintains the liquid fuel at a pressure increased above ambient pressure and excludes air, and which keeps the liquid fuel under pressure during heating, during combustion and during cooling, wherein said blockable fuel valve has a tappet, wherein the closing force of said tappet is greater during the burning start and switch-off phases than the force created by the difference between the forward and return flow pressure, which acts in the opposing direction of said closing force on said valve tappet.

2. The burner as defined in claim 1, wherein said nozzle is a twist nozzle, said twist nozzle being designed as a return flow nozzle with an integrated needle valve.

3. The burner as defined in claim 2, wherein said nozzle defines an opening, and wherein said needle valve unblocks said nozzle opening at a defined, adjustable pressure difference between a forward and return flow pressure.

4. The burner as defined in claim 2, further comprising:

a check valve placed in each fuel line, wherein the lines carrying fuel are closed airtight by means of said needle valve integrated into said return flow nozzle, and by said check valves.

5. The burner as defined in claim 1, wherein the fuel used is such that said at least one fuel heater generates a preheating temperature which is set sufficiently high that the fuel can be vaporized under atmospheric conditions.

6. The burner as defined in claim 1, wherein said nozzle defines an outlet, and wherein the heated fuel is almost completely vaporized by a pressure reduction at said nozzle outlet and mixed with preheated combustion air of the same temperature.

7. The burner as defined in claim 6, wherein part of the fuel forms said colloid-dispersed system and the other part of the fuel forms said molecular-dispersed system with the supplied combustion air after the pressure reduction at said nozzle outlet and mixing with one of: only slightly preheated combustion air and not preheated combustion air.

8. The burner as defined in claim 1, further comprising:

means defining a permeable reaction zone for burning the fuel dispersed in the combustion air.

9. The burner as defined in claim 8, wherein said at least one fuel heater is an electrically operated fuel heater coupled to said reaction zone, wherein the fuel/air mixture is ignited by the surface temperature of said electrically operated fuel heater.

10. The burner as defined in claim 1, further comprising:

an air heater; and a return flow nozzle with an integrated needle valve, wherein said at least one fuel heater, said air heater and said return flow nozzle are provided for preparing the fuel.

11. The burner as defined in claim 1, further comprising:

a fuel regulating device; and burner control means, wherein the pressure difference between a forward and return flow pressure during a burner operating cycle is changed by said burner control means according to one of: continuously, in stages, and pulsating, depending on said fuel regulating device employed.

12. The burner as defined in claim 1, wherein said colloid-dispersed and/or said molecular-dispersed fuel-air mixture is burned.

13. The burner as defined in claim 1, further comprising:

a recirculating pump, wherein said recirculating pump transfers fuel by pumping during the burner start phase when the pressure difference between the forward and return flow pressure is small and said blockable fuel valve is closed.

14. The burner as defined in claim 1, further comprising:

a fuel pump; and a heat exchanger, wherein that fuel which is conveyed back to said fuel pump is used for preheating the combustion air in said heat exchanger.

15. The burner as defined in claim 1, further comprising:

a fuel feed line;

a fuel return flow line; and a fuel valve connecting the fuel feed line and the fuel return flow line, wherein as a result of: one of a defined pressure difference between the pressure in said feed line and the pressure in said return flow line; a defined temperature of the fuel in an interior chamber of said fuel valve; and a defined pressure difference between the pressure in said feed line and the pressure in said return flow line and the defined temperature of the fuel in said interior chamber of said fuel valve, said fuel valve is opened.

16. The burner as defined in claim 15, wherein said fuel valve comprises a simplex nozzle having a closing piston.

17. The burner as defined in claim 15, wherein said fuel valve is such that when it is open an induction effect is generated for the combustion air thus making possible the operation of the burner without the need of a blower.

18. The burner as defined in claim 1, further comprising:

a pressure compensation vessel provided in said feed line.

19. The burner as defined in claim 18, wherein said compensation vessel comprises a bellows.

20. The burner as defined in claim 19, wherein said bellows is a metal bellows.

21. A prevaporizing and premixing burner for liquid fuels, comprising:

at least one fuel heater for heating the liquid fuel;

means for increasing the pressure of the liquid fuel;

a nozzle for atomizing and vaporizing the fuel and for mixing the fuel with combustion air, wherein at least a portion of the vaporized fuel condenses, creating thereby one of: a colloid-dispersed fuel-air mixture, a molecular-dispersed fuel-air mixture, and a colloid-dispersed and molecular-dispersed fuel-air mixture;

a hydraulic system with a blockable fuel valve which, during heating and prior to combustion, and during cooling following combustion, maintains the liquid fuel at a pressure increased above ambient pressure and excludes air, and which keeps the liquid fuel under pressure during heating, during combustion and during cooling;

an air heater;

a return flow nozzle with an integrated needle valve, wherein said at least one fuel heater, said air heater and said return flow nozzle are provided for preparing the fuel; and a fuel regulating device which opens the bore of said return flow nozzle by means of a needle valve in said return flow nozzle by one of: lowering said return flow pressure; raising said forward flow pressure; and lowering said return flow pressure and raising said forward flow pressure, when the required fuel temperature has been reached, such that a mixture formation is made possible.

22. A prevaporizing and premixing burner for liquid fuels, comprising:

at least one fuel heater for heating the liquid fuel;

means for increasing the pressure of the liquid fuel;

a nozzle for atomizing and vaporizing the fuel and for mixing the fuel with combustion air, wherein at least a portion of the vaporized fuel condenses, creating thereby one of: a colloid-dispersed fuel-air mixture, a molecular-dispersed fuel-air mixture, and a colloid-dispersed and molecular-dispersed fuel-air mixture;

a hydraulic system with a blockable fuel valve which, during heating and prior to combustion, and during cooling following combustion, maintains the liquid fuel at a pressure increased above ambient pressure and excludes air, and which keeps the liquid fuel under pressure during heating, during combustion and during cooling;

means defining a permeable reaction zone for burning the fuel dispersed in the combustion air; and a fuel regulating device, wherein the fuel supply in said permeable reaction zone is switched off by one of: raising the return flow pressure; lowering the forward flow pressure; and raising the return flow pressure and lowering the forward flow pressure to the level of the return flow pressure, depending on said fuel regulating device used.

* * * * *